US008091533B2

(12) United States Patent
Ng et al.

(10) Patent No.: US 8,091,533 B2
(45) Date of Patent: Jan. 10, 2012

(54) ENGINE ASSEMBLY INCLUDING CENTRALLY LOCATED FUEL RAIL

(75) Inventors: Kwok Y. Ng, Rochester Hills, MI (US); Joel Cowgill, Walled Lake, MI (US); Rodney K. Elnick, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 289 days.

(21) Appl. No.: 12/407,251

(22) Filed: Mar. 19, 2009

(65) Prior Publication Data

US 2010/0236525 A1 Sep. 23, 2010

(51) Int. Cl.
*F02M 69/46* (2006.01)
*F02M 69/50* (2006.01)

(52) U.S. Cl. ..... 123/456; 123/470

(58) Field of Classification Search ..... 123/456, 123/470, 468, 193.5, 193.3, 184.38, 184.14
See application file for complete search history.

(56) References Cited

U.S. PATENT DOCUMENTS

| | | | | |
|---|---|---|---|---|
| 5,511,520 | A * | 4/1996 | Regueiro | 123/193.5 |
| 6,367,246 | B1 * | 4/2002 | Hirota et al. | 60/295 |
| 6,408,808 | B1 * | 6/2002 | Yi | 123/90.27 |
| 2007/0240671 | A1 * | 10/2007 | Imazato et al. | 123/193.5 |
| 2008/0276899 | A1 * | 11/2008 | Schmidt | 123/193.5 |

FOREIGN PATENT DOCUMENTS

JP 2002061357 A 3/2002

* cited by examiner

*Primary Examiner* — Mahmoud Gimie

(57) ABSTRACT

An engine assembly may include an engine block, a cylinder head, a fuel injector, and a fuel rail. The engine block may define a cylinder bore. The cylinder head may be coupled to the engine block and may define an intake port, an exhaust port, and a centrally located fuel injector opening between the intake port and the exhaust port. The fuel injector opening may be in direct communication with the cylinder bore. The fuel injector may be located within the fuel injector opening. The fuel rail may overlay the fuel injector opening and may be in communication with a fuel supply and the fuel injector.

20 Claims, 5 Drawing Sheets

FIG 5
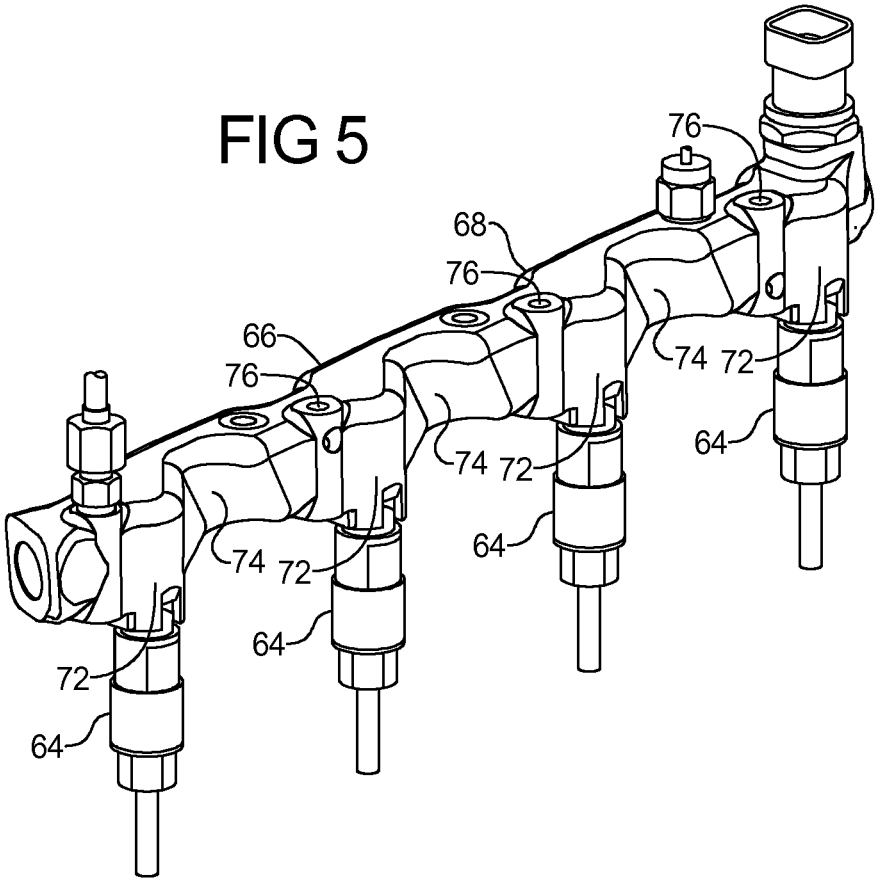
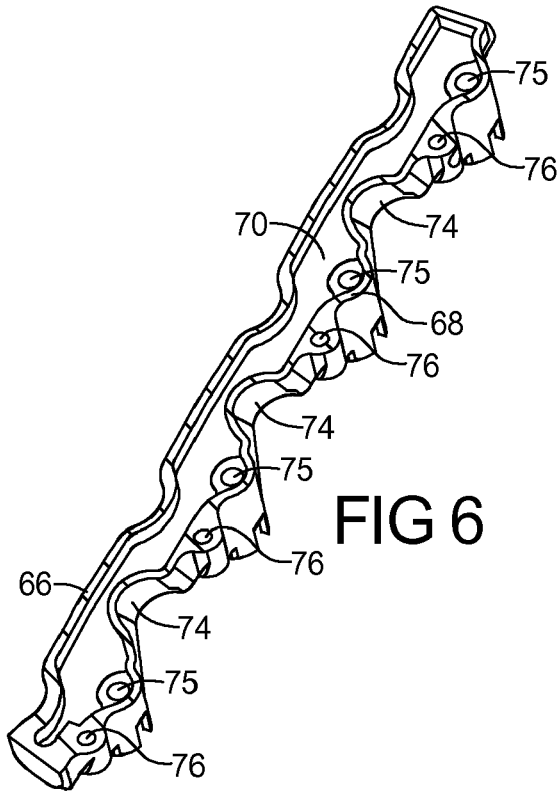
FIG 6

ENGINE ASSEMBLY INCLUDING CENTRALLY LOCATED FUEL RAIL

FIELD

The present disclosure relates to the location and geometry of fuel rails in engine assemblies.

BACKGROUND

This section provides background information related to the present disclosure which is not necessarily prior art.

Engine assemblies typically include a fuel rail to distribute fuel to fuel injectors. In central direct injection applications, the fuel injectors may be located between the intake and exhaust valves. The fuel rail may be located along a side of the cylinder head and a conduit may extend from the fuel rail to each fuel injector to provide fuel to the fuel injector. This location of the fuel rail occupies additional space, creating packaging constraints.

SUMMARY

This section provides a general summary of the disclosure, and is not comprehensive of its full scope or all of its features.

An engine assembly may include an engine block, a cylinder head, a fuel injector, and a fuel rail. The engine block may define a cylinder bore. The cylinder head may be coupled to the engine block and may define an intake port, an exhaust port, and a centrally located fuel injector opening between the intake port and the exhaust port. The fuel injector opening may be in direct communication with the cylinder bore. The fuel injector may be located within the fuel injector opening. The fuel rail may overlay the fuel injector opening and may be in communication with a fuel supply and the fuel injector.

An alternate engine assembly may include an engine block defining a cylinder bore, an intake camshaft, an exhaust camshaft, a cylinder head coupled to the engine block, a fuel injector, and a fuel rail. The cylinder head may include an intake region rotatably supporting the intake camshaft, an exhaust region rotatably supporting the exhaust camshaft, and a central region located between the intake and exhaust regions. The central region may define a fuel injector opening in direct communication with the cylinder bore. The fuel injector may be located within the fuel injector opening. The fuel rail may be located within the central region and may be in communication with a fuel supply and the fuel injector.

An alternate engine assembly may include an engine block defining a cylinder bore, a cylinder head coupled to the engine block, a fuel injector, and a fuel rail. The cylinder head may include an intake region rotatably supporting an intake camshaft, an exhaust region rotatably supporting an exhaust camshaft, and a central recessed region located between the intake and exhaust regions. The central recessed region may define a base having walls extending therefrom. The base may include a fuel injector opening therethrough in direct communication with the cylinder bore. The fuel injector may be located within the fuel injector opening. The fuel rail may be in communication with a fuel supply and the fuel injector and may be located within the central recessed region and surrounded by the walls.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

FIG. 5 is a perspective view of the fuel rail of the engine assembly of FIG. 1; and FIG. 6 is a section view of the fuel rail of FIG. 5.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
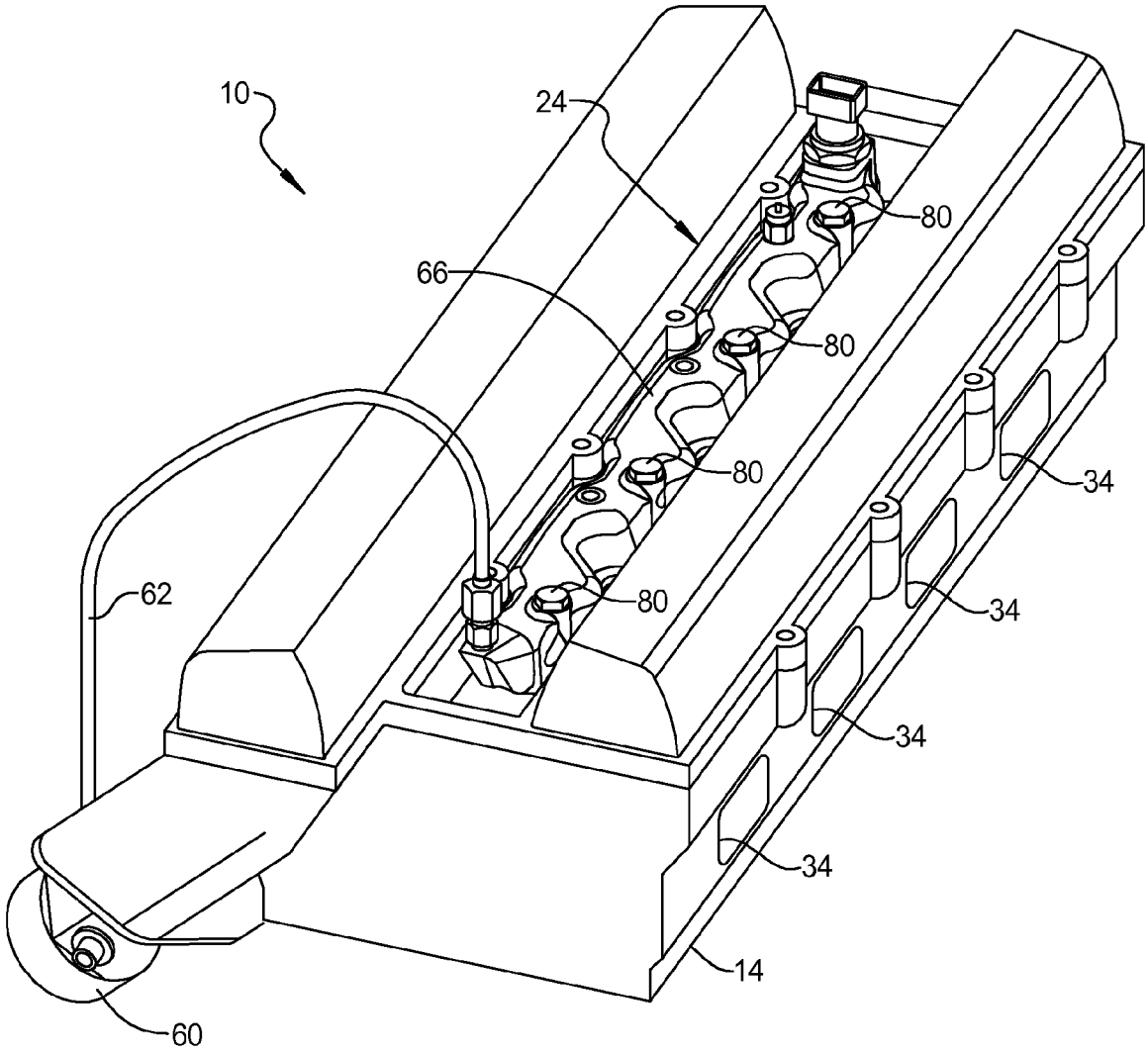
FIG. 1 is perspective view of a portion of an engine assembly according to the present disclosure.
Figure 2:
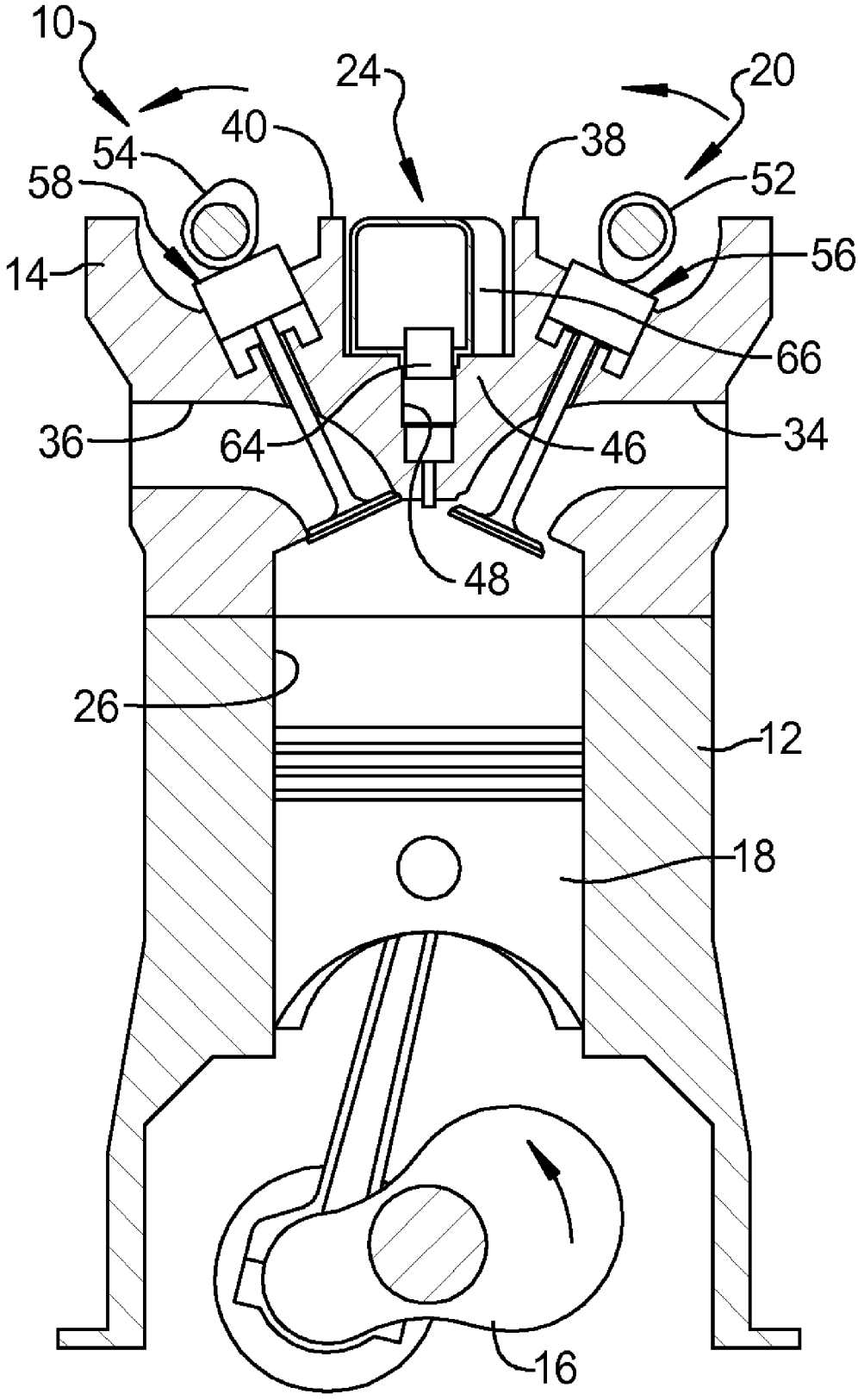
FIG. 2 is a fragmentary section view of the engine assembly of FIG. 1.
Figure 3:
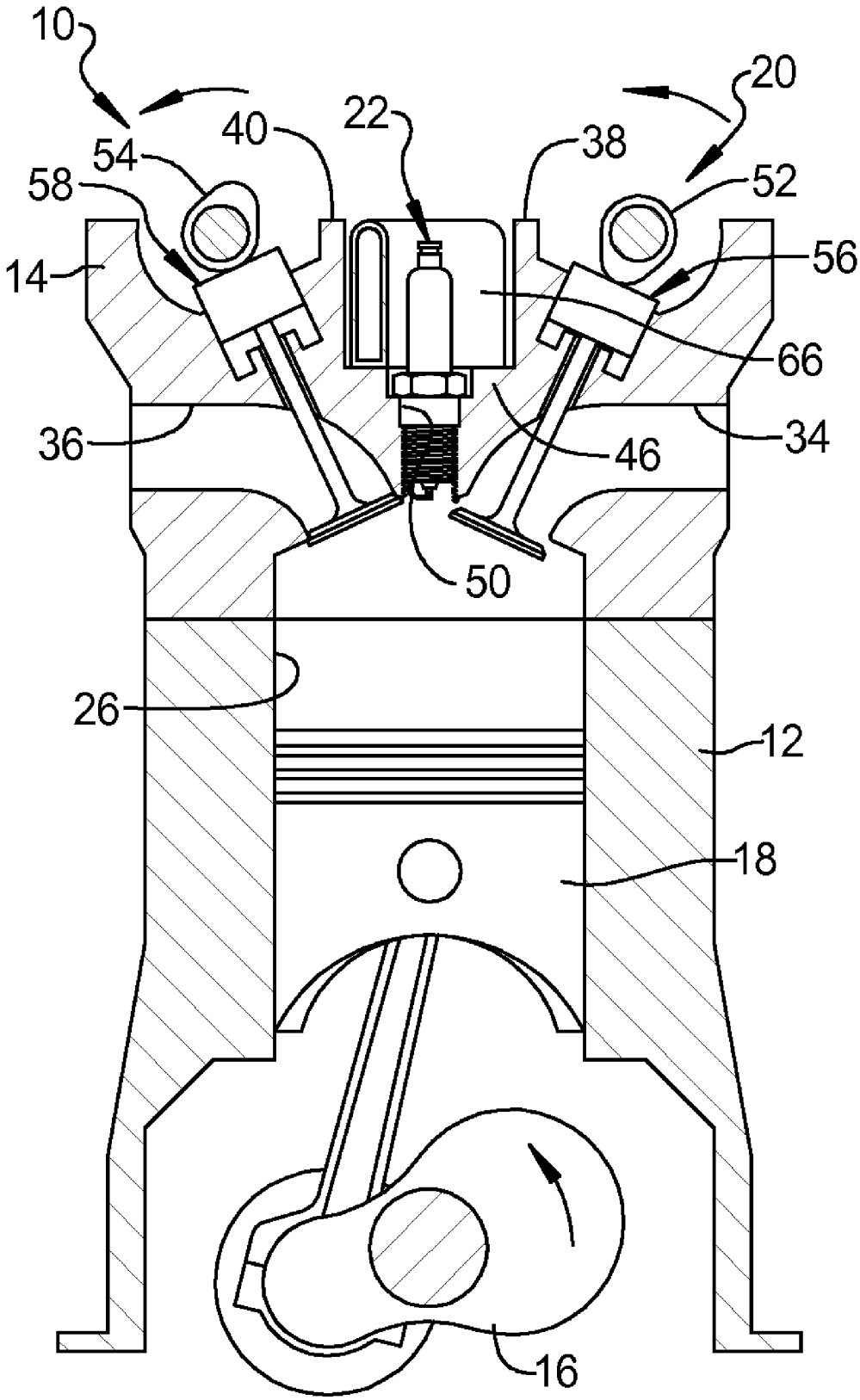
FIG. 3 is an additional fragmentary section view of the engine assembly of FIG. 1.
Figure 4:
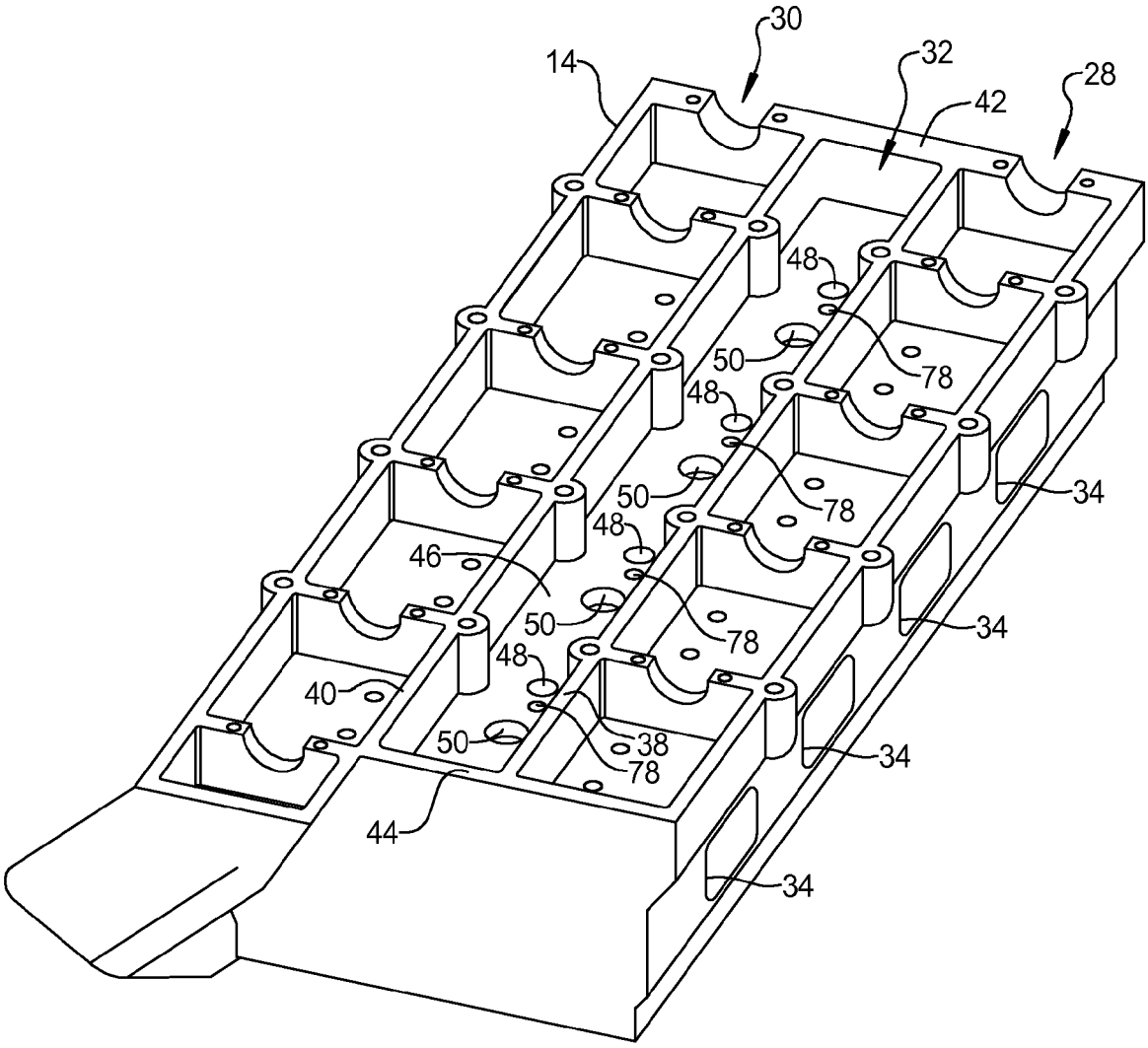
FIG. 4 is a perspective view of the cylinder head of the engine assembly of FIG. 1.

As seen in FIGS. 1-4, an engine assembly 10 may include an engine block 12, a cylinder head 14, a crankshaft 16, pistons 18 (one of which is shown), a valvetrain assembly 20, spark plugs 22 (one of which is shown), and a fuel system 24. The engine block 12 may define cylinder bores 26 (one of which is shown), each having a piston 18 disposed therein. It is understood that the present teachings apply to any number of piston-cylinder arrangements and a variety of engine configurations including, but not limited to, V-engines and inline engines, as well as both overhead cam and cam-in-block configurations.

The cylinder head 14 may be a cast part including an intake region 28 extending longitudinally along the cylinder head 14 on a first lateral end thereof, an exhaust region 30 extending longitudinally along the cylinder head 14 on a second lateral end thereof generally opposite the first lateral end, and a central region 32 extending longitudinally along the cylinder head 14 and located laterally between the intake and exhaust regions 28, 30.

The intake region 28 may include intake ports 34 and the exhaust region 30 may include exhaust ports 36. The central region 32 may form a recessed region defined by first and second longitudinally extending walls 38, 40, first and second laterally extending walls 42, 44, and a base 46. The first and second longitudinally extending walls 38, 40 and the first and second laterally extending walls 42, 44 may extend upward from the base 46. However, it is understood that the present disclosure is not limited to configurations where the central region 32 is surrounded by first and second longitudinally extending walls 38, 40 and/or first and second laterally extending walls 42, 44. The base 46 may include fuel injector openings 48 and spark plug openings 50 extending therethrough. The fuel injector openings 48 and spark plug openings 50 may generally be inline with one another along the longitudinal extend of the cylinder head 14. The fuel injector openings 48 and the spark plug openings 50 may be in direct communication with the cylinder bore 26.

The valvetrain assembly 20 may be supported by the cylinder head 14 and may include intake and exhaust camshafts 52, 54 and intake and exhaust valve assemblies 56, 58. The intake camshaft 52 may be rotatably supported on the intake region 28 of the cylinder head 14 and may be engaged with the intake valve assembly 56. The exhaust camshaft 54 may be engaged with the exhaust valve assembly 58.

The fuel system 24 may include a fuel pump 60, a fuel line 62, fuel injectors 64, and a fuel rail 66. The fuel pump 60 may be driven by the intake camshaft 52 and may be in fluid communication with the fuel rail 66 via the fuel line 62. The fuel injectors 64 may be located in the fuel injector openings 48 and the spark plugs 22 may be located in the spark plug openings 50. Therefore, the fuel injectors 64 may be located in the central region 32 of the cylinder head 14 between the intake and exhaust valve assemblies 56, 58, forming a central direct injection configuration. The fuel injectors 64 may be directly coupled to the fuel rail 66. The fuel rail 66 may be located within the central region 32 of the cylinder head 14 and supported in the base 46. The fuel rail 66 may be located between the first and second longitudinally extending walls 38, 40 and between the first and second laterally extending walls 42, 44.

With additional reference to FIGS. 5 and 6, the fuel rail 66 may be formed as a cast member and may include a longitudinally extending non-linear body 68. The non-linear body 68 of the fuel rail 66 may define a non-linear fluid path 70 therein. The non-linear body 68 of the fuel rail 66 may include fuel injector mounting regions 72 and recessed regions 74. The recessed regions 74 may be located between adjacent fuel injector mounting regions 72 and may extend laterally inward relative to the fuel injector mounting regions 72. The fuel injector mounting regions 72 may include openings 75 receiving the fuel injectors 64 therein.

The fuel rail 66 may additionally include mounting apertures 76 aligned with threaded apertures 78 in the base 46 of the central region 32 of the cylinder head 14. Fasteners 80 may extend through the mounting apertures 76 and into the threaded apertures 78 in the base 46 to directly couple the fuel rail 66 to the cylinder head 14 between the intake and exhaust regions 28, 30.

When the fuel rail 66 is fixed to the cylinder head 14, the injector mounting regions 72 may overlay the fuel injector openings 48 and the recessed regions 74 may extend around the spark plug openings 50. The recessed regions 74 may generally provide access to the spark plugs 22 and the spark plug openings 50 after the fuel rail 66 is fixed to the cylinder head 14. The location of the fuel rail 66 within the central region 32 of the cylinder head 14 may generally provide an enhanced packaging configuration relative to the fuel rail 66 being located external to the cylinder head 14.

Further, locating the fuel rail 66 within the central region 32 of the cylinder head 14 may provide increased protection of the fuel rail during impacts, such as collisions. Specifically, the first and second longitudinally extending walls 38, 40 and the first and second laterally extending walls 42, 44 may generally surround the fuel rail 66 when the fuel rail 66 is fixed to the cylinder head 14, forming a protective housing for the fuel rail 66.

What is claimed is:

1. An engine assembly comprising:

an engine block defining a cylinder bore;

a cylinder head coupled to the engine block and defining an intake port, an exhaust port, a central recessed region between the intake and exhaust ports and a centrally located fuel injector opening between the intake port and the exhaust port and in direct communication with the cylinder bore;

a fuel injector located within the fuel injector opening; and a fuel rail overlaying the fuel injector opening and in communication with a fuel supply and the fuel injector and located within the central recessed region.

2. The engine assembly of claim 1, wherein the central recessed region defines first and second longitudinally extending walls housing the fuel rail therebetween.

3. The engine assembly of claim 1, further comprising an intake camshaft and an exhaust camshaft rotatably supported on the cylinder head, the fuel rail being located between the intake and exhaust camshafts.

4. The engine assembly of claim 3, wherein the fuel rail extends generally parallel to the intake and exhaust camshafts.

5. The engine assembly of claim 1, wherein the fuel rail includes a longitudinally extending body having a non-linear construction.

6. The engine assembly of claim 1, wherein the cylinder head defines a spark plug opening located between the intake and exhaust ports and inline with the fuel injector opening.

7. The engine assembly of claim 6, wherein the fuel rail includes a longitudinally extending body having a first portion extending laterally outward relative to the spark plug opening and a second portion overlaying the fuel injector opening.

8. The engine assembly of claim 7, wherein the first portion includes a recess extending laterally inward at the spark plug opening.

9. The engine assembly of claim 6, wherein the fuel injector opening and the spark plug opening are inline with one another along a longitudinal extent of the cylinder head.

10. The engine assembly of claim 1, wherein the fuel rail is formed as a casting.

11. The engine assembly of claim 1, wherein the fuel rail includes an opening receiving the fuel injector therein and directly coupling the fuel injector to the fuel rail.

12. The engine assembly of claim 1, wherein the cylinder head includes a cast body defining the central recessed region.

13. An engine assembly comprising:

an engine block defining a cylinder bore;

an intake camshaft;

an exhaust camshaft;

a cylinder head coupled to the engine block and including an intake region rotatably supporting the intake camshaft, an exhaust region rotatably supporting the exhaust camshaft, and a central region located between the intake and exhaust regions defining a fuel injector opening in direct communication with the cylinder bore;

a fuel injector located within the fuel injector opening; and a fuel rail located within the central region and in communication with a fuel supply and the fuel injector.

14. The engine assembly of claim 13, wherein the intake region and the central region are separated by a first longitudinally extending wall defined by the cylinder head, the exhaust region and the central region being separated by a second longitudinally extending wall defined by the cylinder head.

15. The engine assembly of claim 14, wherein the first and second longitudinally extending walls surround first and second lateral sides of the fuel rail.

16. The engine assembly of claim 15, wherein the central region includes a base defining the fuel injector opening, the first and second longitudinally extending walls extending from the base and defining a protective housing, the fuel rail being coupled to the base and secured within the protective housing.

17. An engine assembly comprising:

an engine block defining a cylinder bore;

a cylinder head coupled to the engine block and including an intake region rotatably supporting an intake camshaft, an exhaust region rotatably supporting an exhaust camshaft, and a central recessed region located between the intake and exhaust regions and defining a base having walls extending therefrom, the base including a fuel injector opening therethrough in direct communication with the cylinder bore;

a fuel injector located within the fuel injector opening; and a fuel rail in communication with a fuel supply and the fuel injector, the fuel rail being located within the central recessed region and surrounded by the walls.

18. The engine assembly of claim 17, wherein the fuel rail is coupled to the base.

19. The engine assembly of claim 17, wherein the fuel rail includes an opening receiving the fuel injector therein and directly coupling the fuel injector to the fuel rail.

20. The engine assembly of claim 17, wherein the base defines a spark plug opening longitudinally inline with the fuel injector opening, the fuel rail including a longitudinally extending body having a first portion extending laterally outward relative to the spark plug opening and a second portion overlaying the fuel injector opening

* * * * *